United States Patent [19]

Häcker et al.

[11] Patent Number: 4,866,821

[45] Date of Patent: Sep. 19, 1989

[54] MECHANISM FOR SEPARATING THREADS HELD IN AN ARRAY

[75] Inventors: Hans-Eugen Häcker; Peter Defranceski, both of Reutlingen, Fed. Rep. of Germany

[73] Assignee: Hermann Wangner GmbH & Co. KG, Reutlingen, Fed. Rep. of Germany

[21] Appl. No.: 222,860

[22] Filed: Jul. 22, 1988

[30] Foreign Application Priority Data

| | | | |
|---|---|---|---|
| Apr. 20, 1987 | [DE] | Fed. Rep. of Germany | 88106286 |
| Jul. 27, 1987 | [DE] | Fed. Rep. of Germany | 3724822 |
| Sep. 29, 1987 | [DE] | Fed. Rep. of Germany | 8713074 |

[51] Int. Cl.[4] ..... D03D 41/00; D03D 3/04

[52] U.S. Cl. ..... 28/141; 28/202

[58] Field of Search ..... 28/141, 202, 203, 204, 28/205, 206, 207

[56] References Cited

U.S. PATENT DOCUMENTS

| | | | |
|---|---|---|---|
| 977,166 | 11/1910 | Colman | 28/202 |
| 2,313,195 | 3/1943 | Fleischer et al. | 28/202 |
| 4,581,794 | 4/1986 | Oldroyd et al. | 28/141 |

*Primary Examiner*—Robert R. Mackey

*Attorney, Agent, or Firm*—Sughrue, Mion, Zinn, Macpeak and Seas

[57] ABSTRACT

A separator for successively seizing threads (14) held in an array (28) includes a frame (10) having a front face or recess gap (12) and in which two or more strap or bar needles (15, 16, 18) are slidably disposed side by side. Each needle is provided with a pair of facing hooks (20, 22; 24, 26) at opposite sides of a cutout in its forward edge for cooperatively seizing a single thread for separation when the needles are driven in opposite directions.

6 Claims, 7 Drawing Sheets

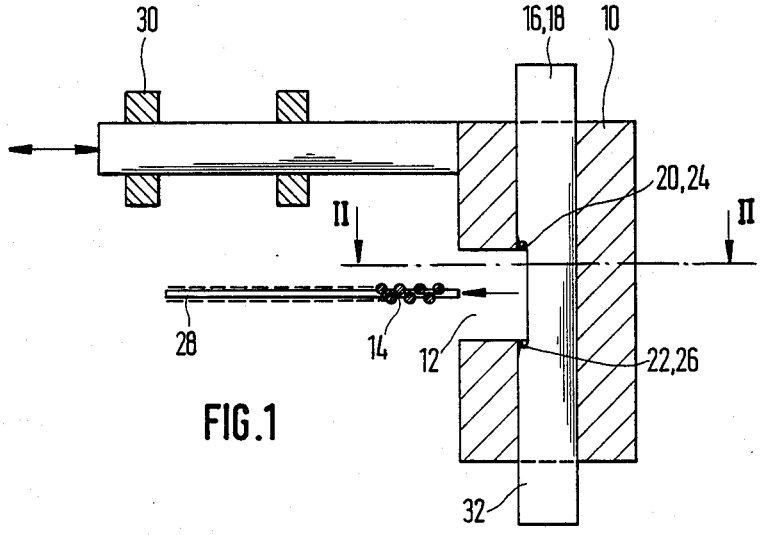
FIG.1
FIG.2a
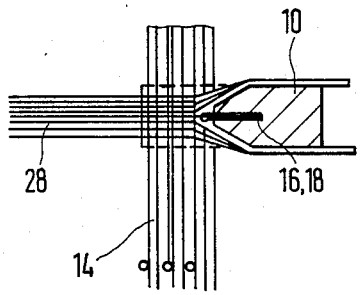
FIG.2b
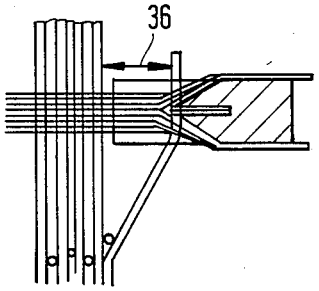

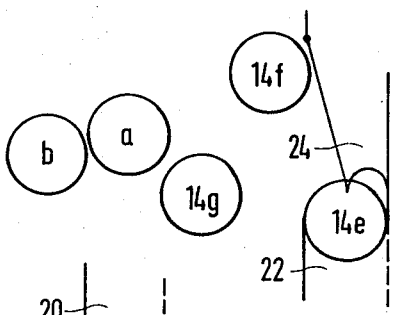
FIG. 4e
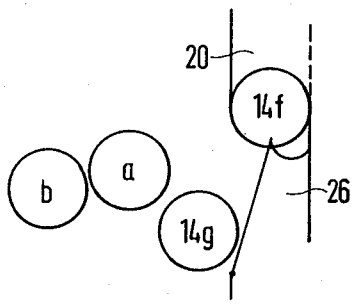
FIG. 4f
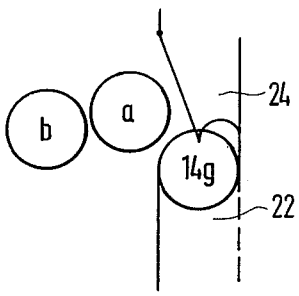
FIG. 4g
FIG. 3
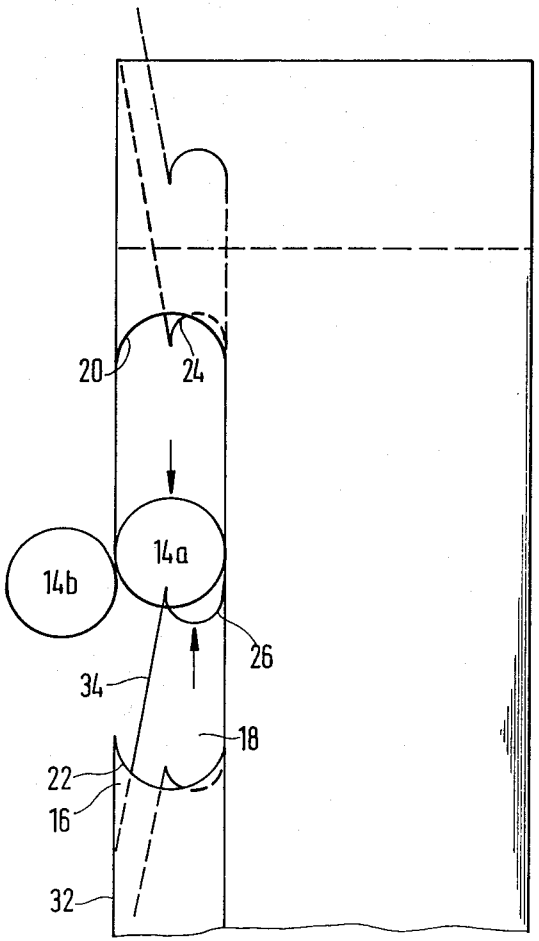

MECHANISM FOR SEPARATING THREADS HELD IN AN ARRAY

BACKGROUND OF THE INVENTION

This invention relates to a separator for successively grasping or seizing threads from an array. The separator includes a frame in which needles are slidably guided and driven in opposite directions. Each needle has a hook(s) freely disposed in a gap in the frame for seizing the foremost thread in the array.

Such separators are employed in weaving machines for joining the two ends of a fabric by a woven seam. The endless fabrics formed by such a seam are used, for example, as sheet formers in the wet section of a paper-making machine. At each end of the fabric, the ends of the warp threads are held by a woven strip in the sequence determined by the weave. Separators are employed to take the warp threads from the woven strip in accordance with this sequence, i.e. to separate them. The separated warp threads are then introduced into the shed of the seam weaving machine. It is essential that the sequence of the warp threads is strictly maintained since otherwise flaws occur in the woven seam which mark the paper. Such a seam weaving machine is disclosed in U.S. Pat. No. 4,410,015.

A separator of the type described is disclosed in DE-U-81 22 450, wherein the thread to be seized is urged by the hook of a single needle against the frame and thus firmly clamped. Since the thread is interwoven in the array, i.e. in the woven strip, and for such clamping the thread must be shifted upwardly or downwardly, the thread occasionally becomes detached from the hook. With the known separator, there is also a risk that two threads become seized by the hook. Although this is signalled by a keystroke on the needle, the seam weaving machine comes to a standstill. Especially when double-layer or multi-layer sheet formers are made endless, there is a high risk that two threads may be seized simultaneously by the separator.

SUMMARY OF THE INVENTION

This invention prevents the simultaneous seizing of two threads by providing at least two needles with hooks facing in mutually opposite directions for positively engaging only the foremost thread of the array. The guidance of two or more needles in the frame ensures that a thread of the array can be safely grasped in any position along the direction of movement of the needles, so that functional disturbances due to unsafe grasping of the thread can no longer occur. The frame is shiftable in the direction of the array to perform a separating stroke so that the seized thread is spatially separated from the next following threads.

For double-layer or multi-layer fabric, it is suitable to use needles each of which has two spaced apart hooks pointing in opposite directions. In this way, the shape of the hook can be adapted to the different diameters of the warp threads in the lower and the upper fabric layer. At the same time, it is possible to somewhat lift or lower the threads by the needle engaging them from below or from above prior to final positive grasping, which occasionally effects better separation from the next following thread.

A thread is positively seized when the hook engaging from one side is made semicircular with a diameter corresponding to the thread diameter, and the cooperating hook engaging from the other side is of similar configuration but only half the diameter so that it bites centrally into the thread and urges it into the other hook.

The needles are actuated according to the fabric weave by known drive means, e.g. pneumatic cylinders, for the seizing stroke. The two needles are moved independently of one another. The frame of the needles can also be moved by a similar drive means for the separating stroke. The needles consist of especially hard steel alloy, and the hooks are suitably arc-shaped at the leading side of the needles; the arc ends semicircularly at its two ends and the tips represent the hooks.

If two needles are employed, a thread to be separated is generally grasped safely, but sometimes it tilts somewhat due to the shear-like engagement by the hooks of the two needles. If this is disadvantageous in some cases, three needles may be used with the two outer needles engaging the thread in a direction opposed to that of the middle needle. This avoids tilting the thread, and instead merely curves it somewhat downwardly or upwardly. With the use of three needles, the middle needle preferably has two hooks corresponding in size to the diameter of the thread to be seized, while the two outer needles have hooks corresponding to about 60% of the thread diameter.

The adaption of the hook size to the thread diameter, and thus an improved operational reliability of the separator, can also be achieved by providing in parallel to the needles and between or beside them one or more stepped plates that are shiftable by drive members. Such a plate has at least one step in its forward edge which extends within the width of one of the hooks so that the hook opening or diameter can be reduced by shifting the plate. Such a stepped plate is especially advantageous when the array contains threads of widely differing diameter, e.g. binder threads of markedly smaller diameter in addition to the longitudinal threads of the upper and lower fabric layers.

Such a stepped plate may be provided between two needles driven in synchronism and having one hook each, where the two hooks, like the single hook provided in DE-U-81 22 450, seize the foremost thread of an array and urge it towards the rim of the frame gap.

The stepped plate preferably has two steps of different height so that it can assume altogether threepositions; in the middle position it does not vary the width of the hook, i.e. the forward edge of the stepped plate is aligned with the leading edge of the needle recess which forms the hook. In the two other positions, the plate preferably reduces the width of the hook by one third or by two thirds, i.e. the heights of the steps are one third or two thirds, respectively, of the needle recess.

BRIEF DESCRIPTION OF THE DRAWINGS

FIG. 1 shows a separator in accordance with the invention, in vertical section perpendicular to the threads to be separated;

FIGS. 2*a* and 2*b* show horizontal sections of the separator taken along line II—II in FIG. 1, in successive operating positions;

FIG. 3 shows an enlarged side view of the separator needle hooks cooperating in positively engaging a thread;

FIGS. 4*a* to 4*g* schematically show the successive seizing of the individual threads of a 7-harness weave;

DETAILED DESCRIPTION OF THE PREFERRED EMBODIMENTS

Figure 4A:
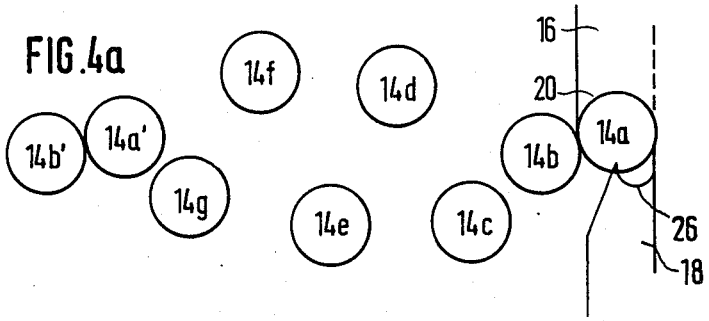

Referring to FIGS. 1 and 2, a separator includes a frame 10 in which a pair of vertically slidable needles 16, 18 are guided side by side. The frame 10 has the shape of a block with a slot extending centrally in the vertical direction to accommodate the needles. On the side facing the threads 14 it has at about mid-height a gap 12 formed by a wide horizontal recess. The gap extends midway into the block so that the leading edges of the needles 16, 18 lie exposed in the opening. The frame 10 is driven by a conventional drive means, not shown, e.g. a pneumatic cylinder or the like, to implement a separating stroke 36 (FIG. 2*b*). The frame 10 is guided by separating stroke guides 30. The needles 16 and 18 are flat steel strips at the gap edge of which hooks 20, 22, 24 and 26 are formed which are spaced apart a distance corresponding approximately to the height of the gap 12. For the formation of the hooks, the two needles 16, 18 have flat recesses at the leading edge which end in tips pointing toward each other. As shown in detail in FIG. 3, the hooks are semicircular, with the diameter of the hooks 20, 22 of the first needle 16 corresponding to the diameter of the threads to be separated. The hooks 24, 26 of the second needle 18 are set back somewhat and are also semicircular, but with only about half the diameter of the hooks of the first needle 16.

As illustrated in FIG. 3, the lower hook 22 of the first needle 16 cooperates with the oppositely directed upper hook 24 of the second needle 18. Both hooks are moved toward each other by conventional drive means, not shown, by shifting the needles in opposite directions so that a thread 14 to be separated comes to lie in the large hook 22 and is urged thereinto by the opposite small hook 24.

The small hook 24 is offset from the leading edge 32 of the needles via an angled edge 34 extending rearwardly by about half the diameter of the semicircle of the large hook 22. The depths of the recesses forming the hooks are also different in the two needles, namely about half the diameter of the threads 14 to be separated for needle 16, and about one fourth the diameter of the threads for needle 18. The tips of the hooks are suitably manufactured by electrical discharge machining.

FIGS. 4*a* to 4*g* successively show the cooperation of the hooks in the separation of the successive threads 14*a* to 14*g* in a 7-harness weave. For reasons of clarity only the threads to be separated, and not the interweaving transverse threads, are shown. Of the separator, only the cooperating hooks of the needles are shown.

In FIG. 4*a*, the thread 14*a* is held between the upper hook 20 of the first needle 16 and the lower hook 26 of the second needle 18. After the positive engagement of the thread 14*a*, the frame 10 is moved to the right in a separating stroke so that the thread 14*a* is spatially separated from the successive threads 14*b*, 14*c*, etc. Due to this spatial separation, the thread 14*a* can then be gripped by grippers and, after release by the hooks 20, 26, it can be introduced by the grippers into the shed of the seam weaving machine.

Figure 4B:
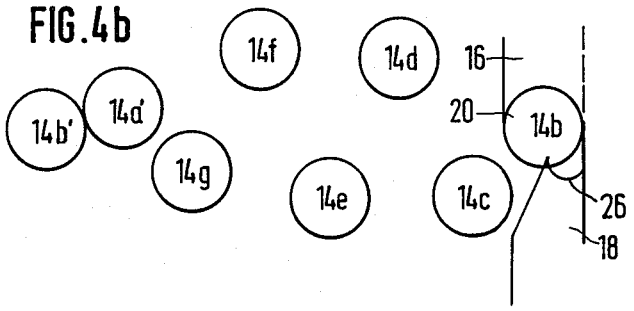

In FIG. 4*b*, the frame 10 has been moved back the length of the separating stroke. Moreover, the slide on which the seam weaving machine is arranged together with the lifting means for the shed formation, the grippers and the drive members for the needles 16, 18 has been moved ahead in line with the rhythm of the weaving operation, namely by the center distance between two threads 14, so that now the next thread 14*b* assumes the deepest position in the gap 12 and can be seized by the upper hook 20 of the first needle 16 and the lower hook 26 of the second needle 18. The thread 14*b* is separated again from the next following threads 14*c*, 14*d*, etc. by the separating stroke, is picked up by the grippers, is released by the hooks 20, 26, and is inserted into the shed by the grippers. The frame 10 is then moved back into its initial position by the length of the separating stroke.

Figure 4C:
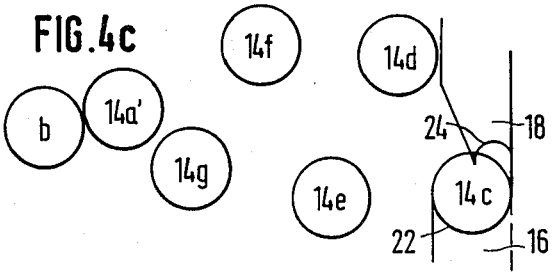

Next the thread 14*c* is seized (FIG. 4*c*). Since in vertical projection the thread 14*c* is somewhat overlapped by the thread 14*d*, it is positively engaged by the lower hook 22 of the first needle 16 and the upper hook 24 of the second needle 18. If the thread 14*c* were seized by the upper hook 20 of the first needle 16 and by the lower hook 26 of the second needle 18, there is a risk that the upper hook would cut into the thread 14*d* and carry it along, and thus both of the threads 14*c* and 14*d* would be separated out together. These two threads would then enter the shed and cause a flaw.

Figure 4D:
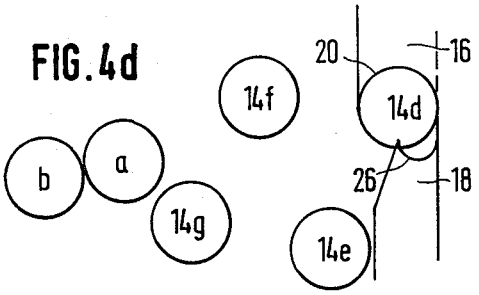

The thread 14*d* is next seized by the upper hook 20 and by the lower hook 26 (FIG. 4*d*). The thread 14*e* is then seized by the upper hook 24 of the second needle and by the lower hook 22 of the first needle (FIG. 4*e*). With the use of the upper hook 20 of the first needle 16, there would be the risk that the needle would cut into the thread 14*f*. The thread 14*f* is then seized by the upper hook 20 and the lower hook 26, whereafter the thread 14*g* is seized by the upper hook 24 and the lower hook 22 (FIGS. 4*f* and 4*g*, respectively). Separation, release, and introduction into the shed are performed as described for thread 14*a* in FIG. 4*a*.

Figure 5:
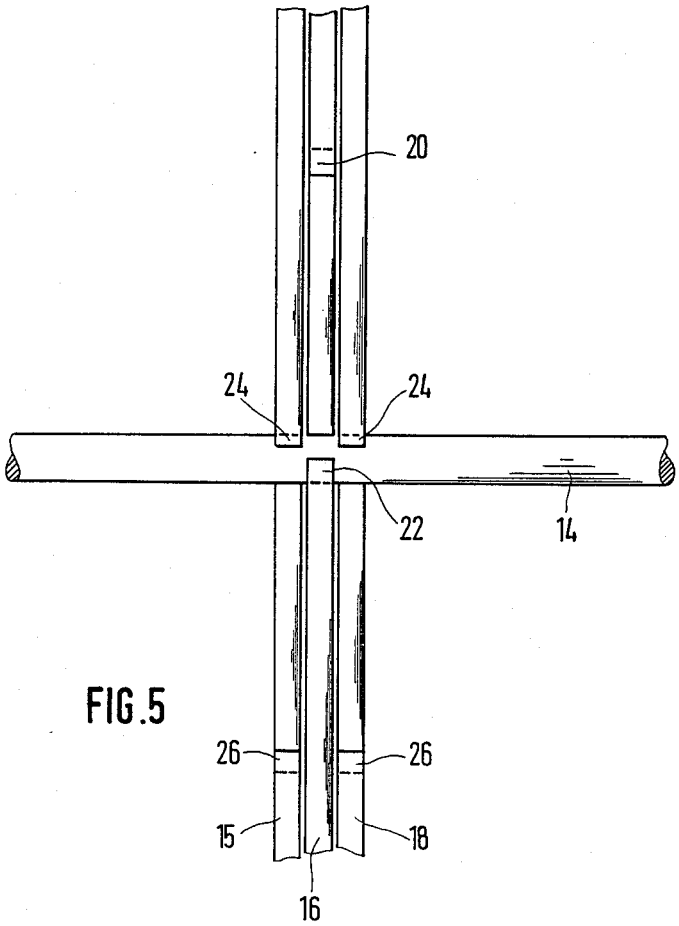
FIG. 5 shows a front view, facing the gap, illustrating the seizing of a thread using three needles.

With the use of two needles, they engage the thread to be separated in a manner similar to a shear, such that the thread is tilted a little. Occasionally such tilting is a nuisance. It may be avoided by the use of three needles 15, 16, 18, as shown in FIG. 5. The two outer needles 15 and 18 are set back, like the needle 18 in the two-needle embodiment shown in FIG. 3. Since the two outer needles 15 and 18 are moved in synchronism, they can be mechanically interconnected and controlled by a single drive means. With the use of three needles, a thread to be separated is grasped safely without damage, and without any tilting or the possibility of the thread evading the force exerted by the needles.

Figure 6:
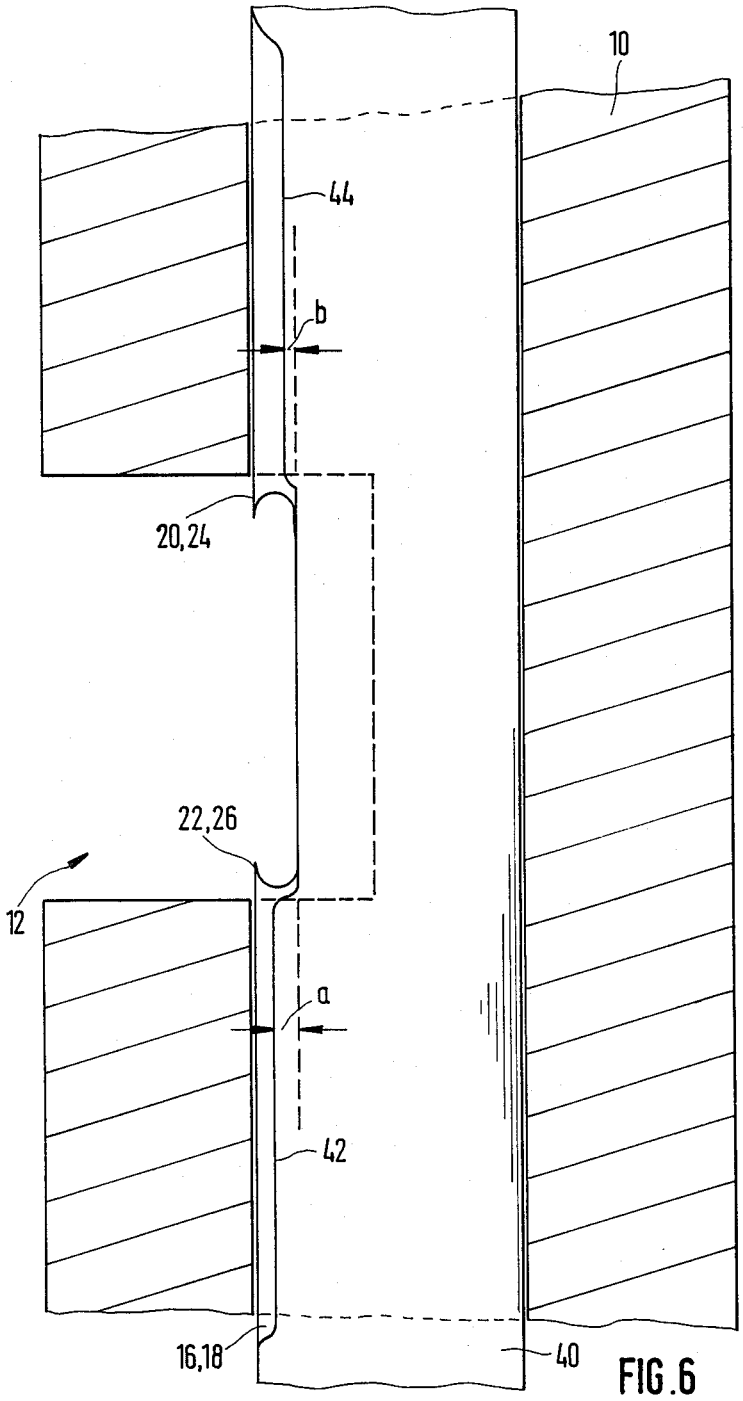
FIG. 6 shows a side view of the gap in a separator provided with a stepped plate.
Figure 7:
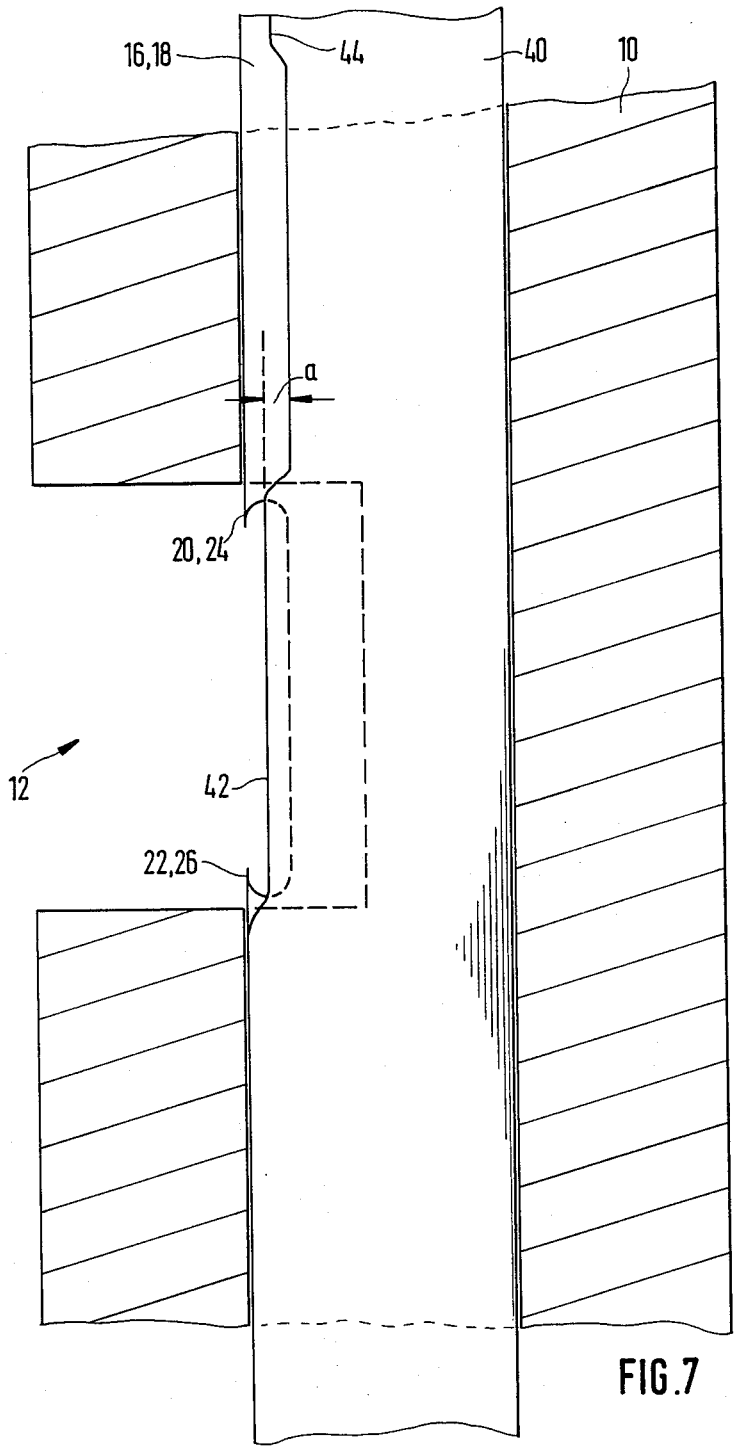
FIG. 7 is a view similar to that of FIG. 6 where the effective width of the hook is reduced by shifting the stepped plate.

FIGS. 6 and 7 show an example of a separator, similar to that of FIG. 3, in which all the hooks 20, 22, 24, 26 are of equal size and a stepped plate 40 is provided. The needles 16, 18 are shown in their basic position so that one covers the other in the drawing. The plate 40 has two steps 42, 44 of different heights a and b, respectively, in its front edge. It is driven in a manner similar to the drive of the needles 16, 18.

In FIG. 6, the plate 40 is shown in its central position where it does not reduce the effective width of the hooks 20, 22, 24, 26. In this position, the front edge of the stepped plate is thus in alignment with the front edges of the recesses in the forward edges of the needles 16, 18, and a thread 14 whose diameter is equal to the width of the hooks 20, 22, 24 and 26 can be grasped and separated.

In FIG. 7, the stepped plate 40 is shifted upwardly so that its leading edge is offset by the height a of the first step 42 in a forward direction, i.e. toward the array of threads 28. The effective width of the hooks 20, 22, 24 and 26 is thus reduced by the dimension of a so that thinner threads can be safely grasped. Analogous thereto, in a third position of the plate 40 in which the second step 44 appears in the gap 12, threads 14 having a diameter reduced by the dimension b could be safely grasped.

The stepped plate 40 can be arranged between or laterally of the needles 16, 18. The same applies when a plurality of stepped plates 40 are provided. Suitably, it is arranged alongside the group of needles in order that the lateral distance between the needles is as small as possible, and thus the tilting forces acting on the thread are kept at a minimum.

Figure 8:
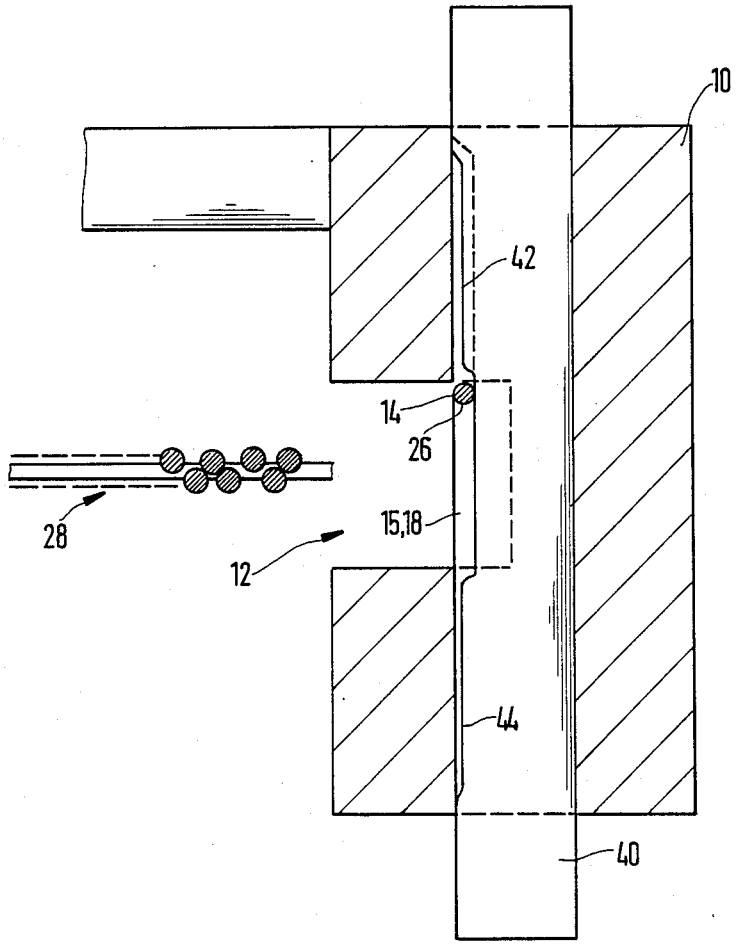
FIG. 8 shows the manner of seizing a thread in a separator with two needles driven in synchronism and each having a hook and a stepped plate slidably arranged between the needles.

In the example illustrated in FIG. 8, the stepped plate 40 is arranged between two needles 15, 18 driven in synchronism. The plate is provided with two steps 42, 44 of differing height, as in FIGS. 6 and 7. The needles 15 and 18, in deviation from the above examples, each have only one hook 26. In order to grasp a thread 14 the hooks 26 urge the thread against the rim of the gap 12. The possibility of very precisely adapting the effective width of the hooks 26 to the diameter of the thread by shifting the stepped plate 40 ensures the safe seizing of a thread, and especially prevents the seizing of several threads at the same time.

In FIG. 8, the hooks 26 urge the thread 14 to be grasped against the upper rim of the gap 12. If the needles 15, 18 instead have downwardly oriented hooks 24, the separator operates such that the hooks urge the thread to be seized against the lower rim of the gap. The needles 15, 18 can also have one downwardly oriented hook 24 and one upwardly oriented hook 26, and in that case, they cooperate with both the upper and lower rims of the gap 12. The hooks 24 and 26 can be of the same or different size, and the actual size can additionally be reduced by the position of the stepped plate 40.

We claim:

1. A separator mechanism for successively and individually seizing threads (14) held in an array (28), comprising: a frame (10) having a horizontal recess (12) defined in a side thereof facing the array of threads, at least two vertically oriented, closely proximate needles (16, !8) slidably guided in said frame, each needle having a cutout in a forward edge thereof defining at least one hook (20, 22; 24, 26), and the hooks of successive needles pointing in opposite, facing directions, drive means for shifting the needles in opposite directions to perform a seizing stroke such that the hooks cooperate to positively engage only a foremost thread of the array, and means for sliding the frame in the direction of the array to perform a separating stroke (36).

2. A mechanism according to claim 2, wherein each needle has two hooks oppositely directed and spaced apart in the direction of the seizing stroke such that one hook (20,24) of one needle (16) and an oppositely directed hook (26, 22) of another needle (18) grasp the thread between them.

3. A mechanism according to claim 2, wherein said one hook (20) corresponds in size to the diameter of the thread to be seized, and said oppositely directed, cooperating hook (26) has about half this size.

4. A mechanism according to claim 1, wherein three needles (15, 16, 18) are provided side by side, two outer ones of which (15, 18) are driven in synchronism opposite to an intermediate needle.

5. A mechanism according to claim 1, wherein a stepped plate (40) is slidably disposed in the frame parallel to the needles and is provided at a forward edge thereof with at least one step (42,44) which extends within the hook defining cutout of one of the needles, and further comprising means for shifting the plate until the step thereof appears in the frame recess such that the effective size of a hook can be reduced.

6. A separator mechanism for successively and individually seizing threads (14) held in an array (28), comprising: a frame (10) having a horizontal recess (12) defined in a side thereof facing the array of threads, two vertically oriented, closely proximate needles (15, 18) each having a cutout in a forward edge thereof defining a hook (24, 26) for seizing the threads, said needles being slidably guided in the frame, drive means for shifting the needles in synchronism such that the hooks engage a foremost thread of the array in the recess and urge said thread against a rim of the recess, a stepped plate (40) slidably disposed in the frame parallel to and between the needles, said plate having at least one step (42, 44) in a forward edge thereof which extends within the hook defining cutout of the needles, means for sliding the plate until the step thereof appears in the frame recess such that the effective size of the hooks can be reduced, and means for sliding the frame in the direction of the array to perform a separating stroke.

* * * * *